US005111679A

United States Patent [19]

Kobayashi et al.

[11] Patent Number: 5,111,679

[45] Date of Patent: May 12, 1992

[54] METHOD FOR FORMING BARREL FOR TWO-PIECE CAN

[75] Inventors: Tomomi Kobayashi; Akira Kobayashi, both of Yokohama; Hiroshi Fujimoto, Tokyo; Norihiko Saiki, Kawasaki; Katsuhiro Imazu, Yokohama, all of Japan

[73] Assignee: Toyo Seikan Kaisha, Ltd., Tokyo, Japan

[21] Appl. No.: 544,725

[22] Filed: Jun. 27, 1990

[30] Foreign Application Priority Data

Jun. 27, 1989 [JP] Japan ..... 1-162806

[51] Int. Cl.[5] ..... B21D 22/20

[52] U.S. Cl. ..... 72/348; 72/347

[58] Field of Search ..... 72/347-349

[56] References Cited

U.S. PATENT DOCUMENTS

| | | | |
|---|---|---|---|
| 3,760,751 | 9/1973 | Dunn et al. | 72/348 |
| 4,289,014 | 9/1981 | Maeder et al. | 72/348 |
| 4,372,143 | 2/1983 | Elert et al. | 72/349 |
| 4,620,434 | 11/1986 | Pulciana et al. | 72/348 |
| 4,685,322 | 8/1987 | Clowes | 72/348 |
| 4,790,169 | 12/1988 | Johansson et al. | 72/354.8 |

FOREIGN PATENT DOCUMENTS

| | | | |
|---|---|---|---|
| 178325 | 7/1989 | Japan | 72/348 |

*Primary Examiner*—Robert L. Spruill
*Assistant Examiner*—Donald M. Gurley
*Attorney, Agent, or Firm*—Sughrue, Mion, Zinn, Macpeak & Seas

[57] ABSTRACT

In a method for forming a barrel for a two-piece can, before the step of draw-forming the bottom, a taper portion having an inner diameter gradually decreasing toward the bottom surface is formed on a lower part of the side wall of a flat-bottom barrel, corresponding to the outer circumferential frustoconical portion of the bottom of the final barrel or an upper portion contiguous to the outer circumferential portion, and at the step of draw-forming the bottom, at least an upper part of the taper portion is outwardly expanded by insertion of the cylindrical punch. According to this method, a two-piece can having a bottom having a good appearance, a high pressure-resistant strength and an excellent corrosion resistance can be prepared at a high productivity and with a good operation adaptability.

2 Claims, 8 Drawing Sheets

FIG. 3-A
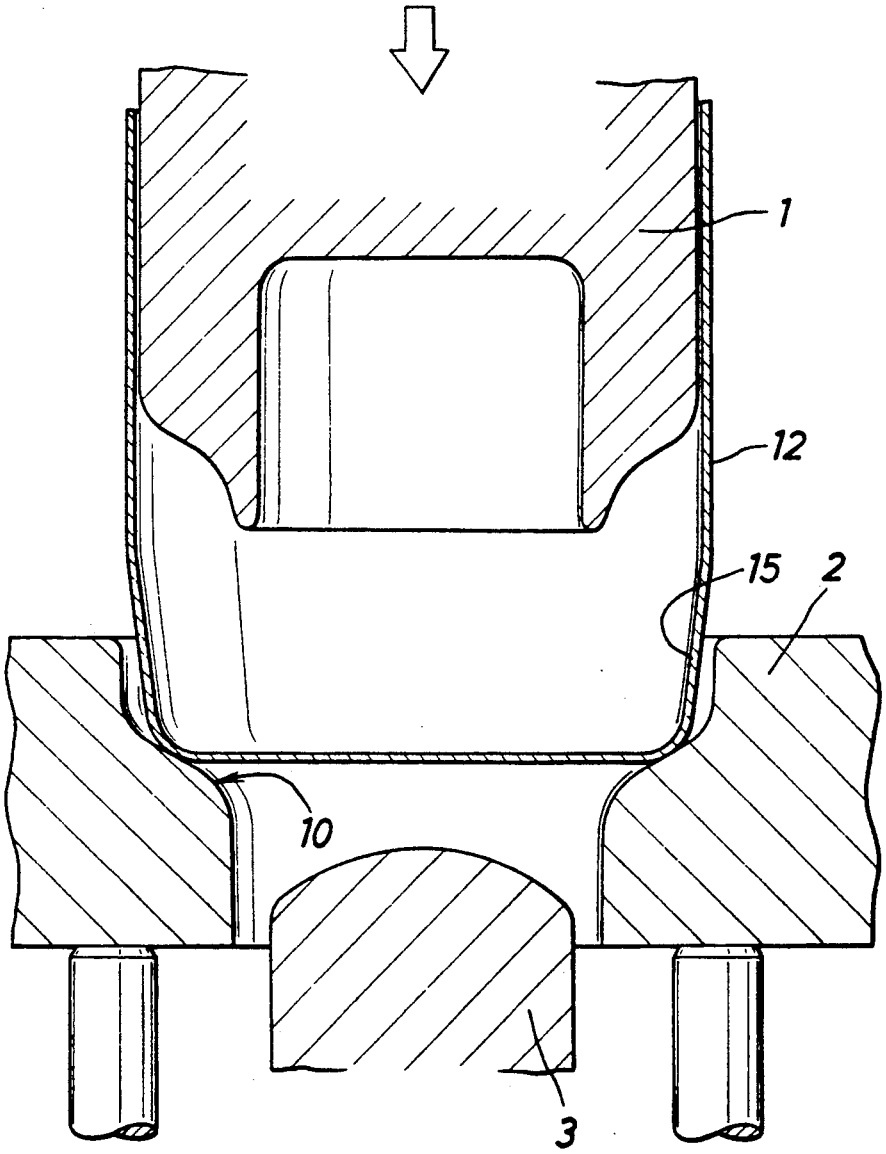

FIG. 3-B
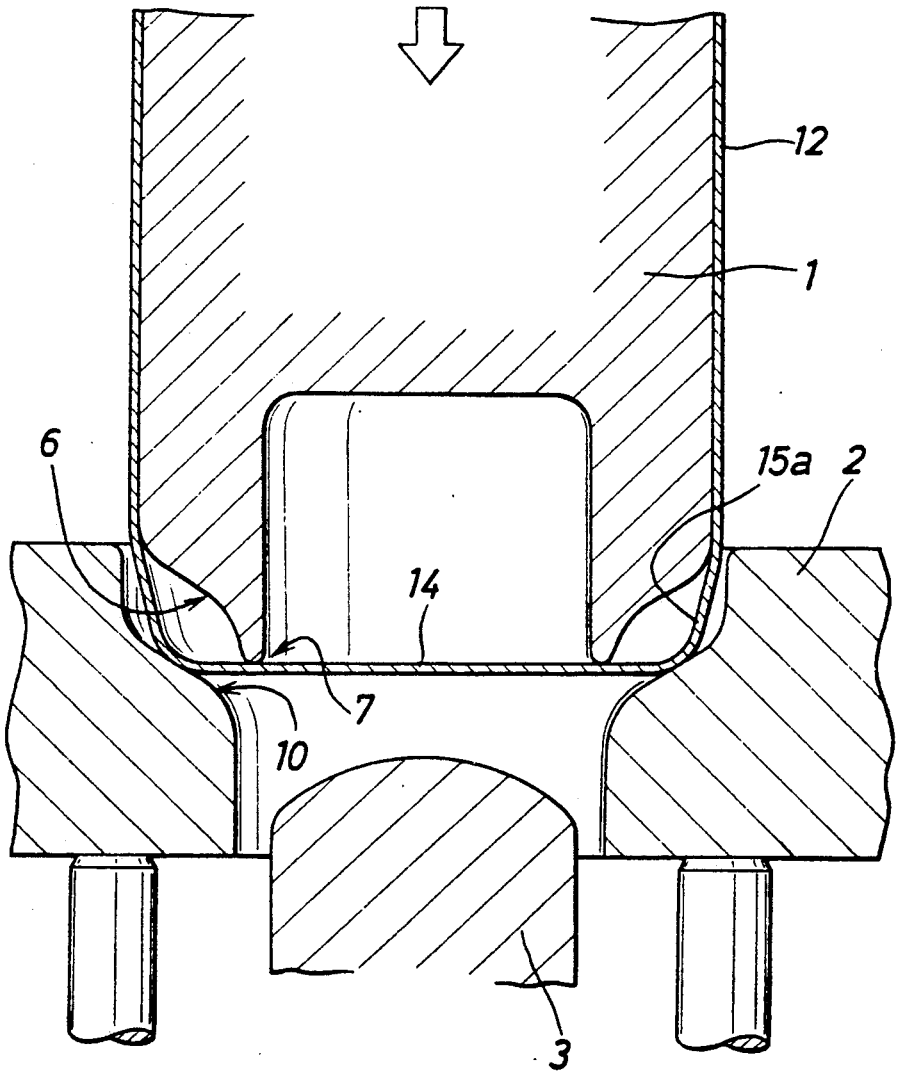

FIG. 3-C
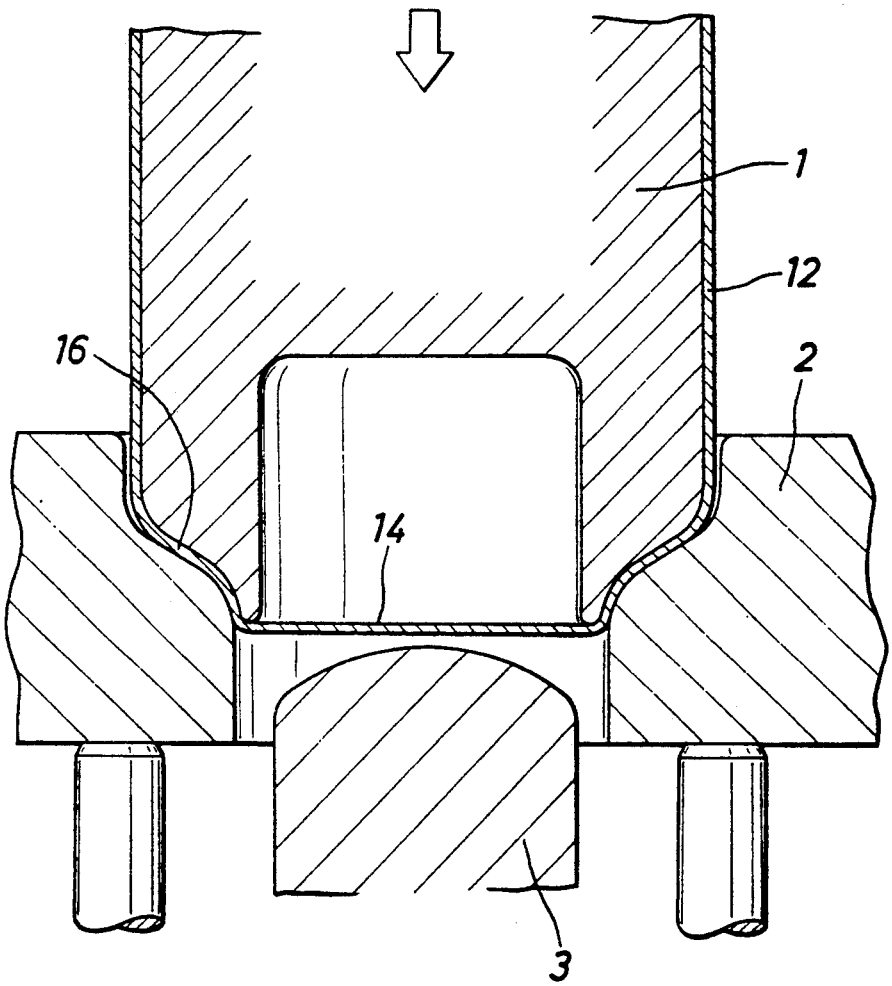

FIG. 3-D
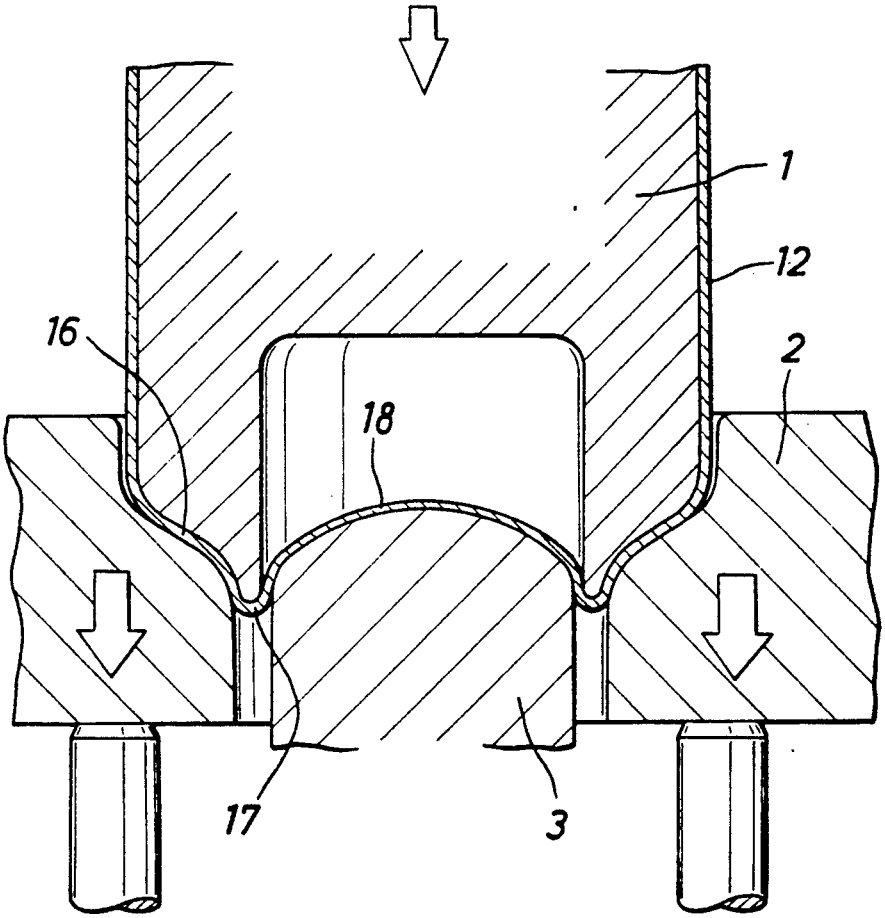

METHOD FOR FORMING BARREL FOR TWO-PIECE CAN

BACKGROUND OF THE INVENTION (1) Filed of the Invention

The present invention relates to a method for forming a barrel for a two-piece can. More particularly, the present invention relates to a method for forming a barrel for a two-piece can having a bottom, which has good appearance, high strength and excellent corrosion resistance. Especially, the present invention relates to a method for forming a barrel for a two-piece can having a bottom, as mentioned above, by using a thin-gauge, high-strength material.

(2) Description of the Related Art

A can body obtained by subjecting a method blank to drawing between a punch and a die and redrawing, and optionally further to ironing, is advantageous in that there is not any seam in a barrel or in a connecting portion between the barrel and bottom and the appearance is good. Further, the operations of seaming a lid and formation of a seam are not necessary and since the thickness of the side wall portion of the barrel is reduced, the amount of the metal blank can be reduced. Accordingly, this can body is widely used for the production of canned drinks and the like.

Since a two-piece can of this type is used for filling a content having a spontaneous pressure, such as beer or a carbonated drink, or for filling a content with nitrogen, a pressure resistance performance is required for the two-piece can, and especially in order to prevent buckling of the bottom, there is generally adopted a method in which an outer circumferential frustoconical portion, a protecting portion (bottom radius portion), an inner circumferential frustoconical portion and a dome portion for connecting these portions smoothly to one another are formed on the bottom toward the center thereof from the outer side.

With recent changes of the taste, in the field of such contents as carbonated drinks and beer, a higher volume ratio of carbon dioxide gas to the total volume tends to be more desired, and in the field of nitrogen-filled canned goods, in view of the filling easiness and the storage stability, a higher nitrogen volume ratio is desired. Accordingly, the pressure resistance required for a barrel for a two-piece can is at such a high level as at least 3 kg/cm$^2$ (gauge), especially at least 6 kg/cm$^2$. In contrast, in order to reduce the can manufacturing cost and reduce the weight of a vessel, use of a thin-gauge high-strength material is desired.

We previously proposed a method for forming a barrel for a two-piece can, having an excellent pressure in the bottom portion, from a thin-gauge high-strength material, which comprises the step of forming a barrel having a flat bottom by subjecting a metal sheet to drawing or draw-ironing, and the step of supporting the bottom of the barrel by a cylindrical punch and an annular die, having shapes corresponding to an outer circumferential frustoconical portion and a projecting portion of the bottom of the final barrel and draw-forming the bottom while engaging the bottom with a doming by having an outer diameter slightly smaller than the inner diameter of the cylindrical punch.

According to the above-mentioned method for draw-forming the bottom, a bottom having an excellent pressure resistance can be formed, but since a compressive stress is generated in the outer circumferential frustoconical portion of the bottom of the final barrel, as the gauge thickness of the metal sheet is reduced and the strength of the metal sheet is increased, the tendency of formation of wrinkles is still observed. Formation of wrinkles in the outer circumferential frustoconical portion of the bottom results in degradation of the appearance of the bottom, and in the case where a covering is formed in advance on the inner or outer surface of the metal blank, latent or actual peeling or damage is caused in the outer surface or inner surface covering material by formation wrinkles. Accordingly, formation of wrinkles should be avoided.

SUMMARY OF THE INVENTION

It is a primary object of the present invention to provide a method for forming a barrel for a two-piece can, in draw-forming the bottom of a barrel into an outer circumferential frustoconical portion, a projecting portion and a dome portion, formation of wrinkles in the outer circumferential portion can be prevented.

Another object of the present invention is to provide a forming method in which a barrel for a two-piece can, having a bottom, which has a good appearance, a high strength and an excellent corrosion resistance, can be prepared from a thin-gauge, high-strength material without formation of wrinkles.

Still another object of the present invention is to provide a method for forming a barrel for a two-piece can, in which in draw-forming of the bottom of a barrel, the compressive stress generated in the outer circumferential frustoconical portion of the bottom can be moderated.

In accordance with the present invention, there is provided a method for forming a barrel for a two-piece can, which comprises the step of forming a barrel having a flat bottom by subjecting a metal sheet to drawing or draw-ironing, and the step of supporting the bottom of the barrel by a cylindrical punch and an annular die, having shapes corresponding to an outer circumferential frustoconical portion and a projecting portion of the bottom of the final barrel and draw-forming the bottom while engaging the bottom with a doming die having an outer diameter slightly smaller than the inner diameter of the cylindrical punch, wherein before the step of draw-forming the bottom, a taper portion having an inner diameter gradually decreasing toward the bottom surface is formed on a lower part of the side wall of the flat-bottom barrel, corresponding to the outer circumferential frustoconical portion of the bottom of the final barrel or an upper portion contiguous to the outer circumferential frustoconical portion, and at the step of draw-forming the bottom, at least an upper part of the taper portion is outwardly expanded by insertion of the cylindrical punch.

In the present invention, it is preferred that the draw-forming of the bottom be carried out so that the following requirements are satisfied:

$$L_2/L_1 > 1.0 \quad (1)$$

$$\frac{D_1 - D_2}{D_2} \times 100 = 0.1 \text{ to } 5\% \quad (2)$$

wherein $L_2$ represents the height of the barrel to be subjected to draw-forming of the bottom, from the bottom surface at the point of initiation of the inclination of the taper portion, $L_1$ represents the height from the bottom surface to the lowermost position of the maximum-diameter portion of the cylindrical punch, $D_1$ represents the diameter of the punch at the height $L_1$, and $D_2$ represents the inner diameter of the barrel at the height, $L_1$.

BRIEF DESCRIPTION OF THE DRAWINGS

FIG. 3-A through 3-D are sectional views showing the step order in the forming method.

DETAILED DESCRIPTION OF THE PREFERRED EMBODIMENTS

Figure 1:
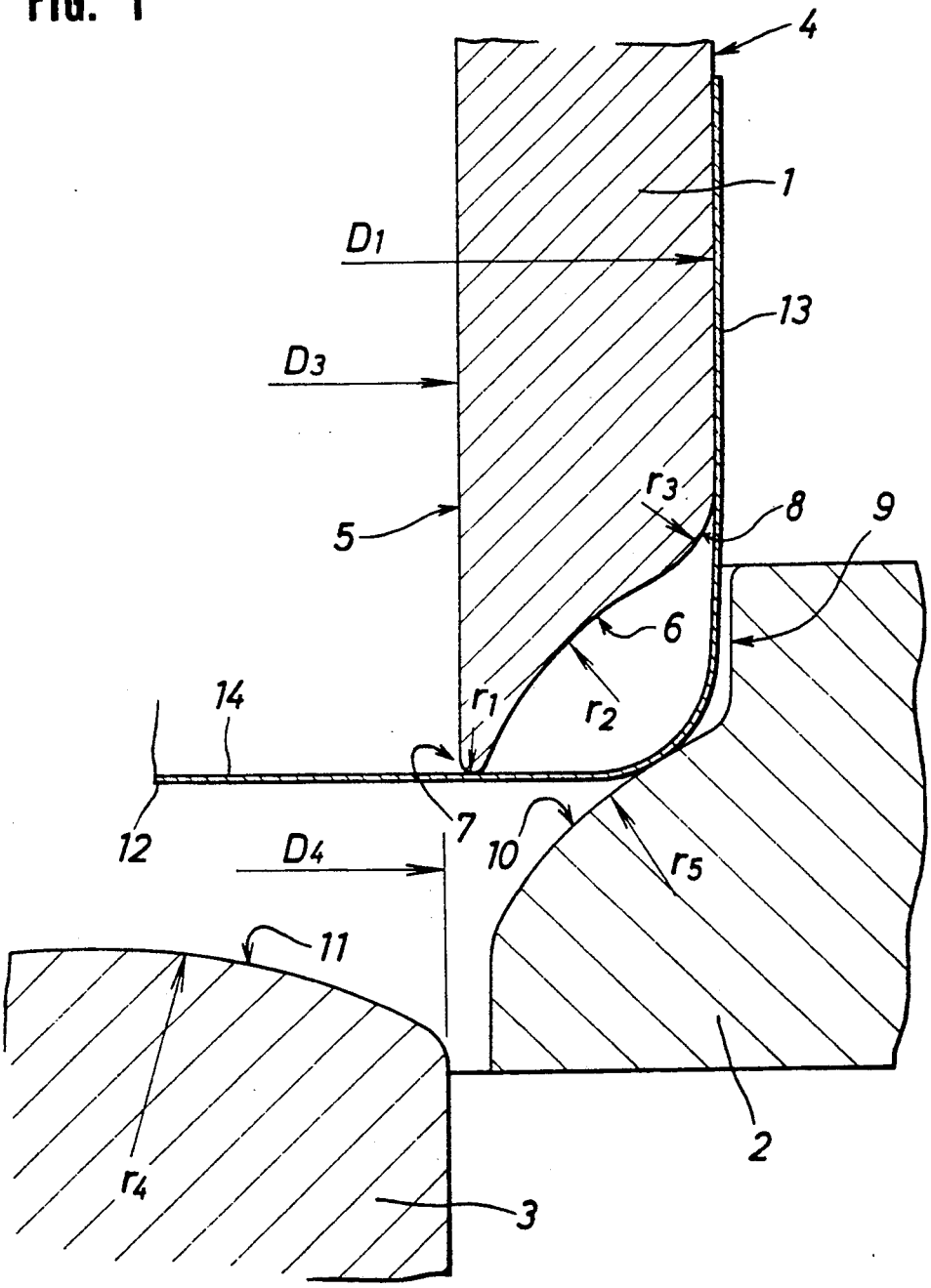
FIG. 1 is a longitudinally sectional view illustrating a main portion of the forming method of the present invention.

In case of a cup having a flat bottom, in the case where the material constituting the outer circumferential portion of the bottom is formed into an outer circumferential frustoconical portion (chime portion) by the forming operation by a cylindrical punch and an annular die, since the circumferential length is reduced, a compressive stress is generated in the material in the circumferential direction. With this decrease of the circumferential length of the material, such a deformation is caused in the material that the thickness is increased and the material is elongated in the height direction. However, in the case where the yield stress of the material is high to some extent or the thickness is small, buckling is caused by this compressive force. That is, wrinkles are formed. This formation of wrinkles is a phenomenon not observed at all in case of a material having an excellent workability, such as a relatively soft aluminum material, or a thick tin-plate sheet.

In the case where wrinkles are thus formed, when the bottom is draw-formed by a doming die while the material is supported by the cylindrical punch and annular die, the material is prevented from flowing into the interior of the cylindrical punch through a projection on the top end of the cylindrical punch, and there is a risk of fracture of the material in the vicinity of the projection where the stress is readily concentrated. If the supporting force of the annular die is set at a high level, it is possible to crush the formed wrinkles to such an extent that the dome forming is not hindered, and to continue the forming operation. In this case, traces of the once formed wrinkles are left to degrade the appearance. Moreover, in the case where a covering is formed in advance on the inner surface or outer surface of the metal material, it is apprehended that the surface covering will be damaged by these wrinkles to such an extent that the function of the covering is substantially lost.

If a shape (taper) having an inner diameter gradually decreasing toward the bottom surface is given to a portion corresponding to the outer circumferential frustoconical portion of the final barrel, that is, a lower part of the side wall of the flat-bottom cup, since the circumference corresponding to the topmost part of the outer circumferential frustoconical portion having a largest outer diameter is inserted into the interior of the flat-bottom cup and when said circumference is further intruded into the lower part of the side wall portion of the flat-bottom cup, the inner diameter of the lower part of the side wall portion of the flat-bottom cup is smaller than the maximum outer diameter of the cylindrical punch, the material is outwardly expanded and a tensile stress is generated in this portion in the circumferential direction. We found that even if a thin or high-strength metal material is used, the thus generated tensile stress in the circumferential direction moderates or cancels the above-mentioned wrinkle-forming compressive stress in the circumferential direction, which causes formation of wrinkles when the forming is further advanced, and we succeeded in forming a can bottom having a pressure resistance while effectively controlling formation of wrinkles in the outer circumferential frustoconical portion, based on this finding.

It is important that the position of initiation of the decrease of the inner diameter in the lower part of the barrel wall of the flat-bottom cup should be substantially the same as the portion of the topmost part of the outer circumferential frustoconical portion of the intended barrel, or a position remote from said position toward the open end. The reason is that generation of wrinkles starts at a relatively initial stage of the forming step where the clearance between the cylindrical punch and the annular die is large and it is necessary that the above-mentioned tensile stress in the circumferential direction should be generated at this stage. For this reason, in the present invention, the value of $L_2/L_1$ is defined as represented by the above-mentioned formula (1).

There is an optimum range for the interference $(D_1-D_2)$ (the difference between the outer diameter of the topmost part of the outer circumferential frustoconical portion of the cylindrical punch and the inner diameter of the lower part of the barrel wall) at this time. The reason is that if the interference is too large, the tensile stress in the circumferential direction becomes too large and exceeds the fracture limit, resulting in breaking of the barrel, and if the interference is too small, the compressive stress in the circumferential direction, causing formation of wrinkles, is not sufficiently moderated or canceled and the intended effect cannot be attained. For this reason, the value of $(D_1-D_2)/D_2$ is defined as represented by the formula (2).

It also is important that the radius $R_p$ of curvature necessarily given when a flat-bottom cup is formed, that is, the average radius of curvature of the section of the curved portion connecting the bottom having a flat plane to the barrel wall having a cylindrical plane, should be as large as possible. The reason is that if the material has such a curved plane, this means that a certain rigidity to the compressive stress in the circumferential direction is given to the material, and if the radius of curvature is large, this effect is given to a broad region of the outer circumferential frustoconical portion. Furthermore, if the value of $R_p$ is increased, since the material of this portion is located more inwardly of the punch, the quantity of deformation at the forming is decreased and the compressive stress causing formation of wrinkles is decreased.

The presence of wrinkles in the portion corresponding to the outer circumferential frustoconical portion already in the state of a flat-bottom cup should be avoided. The reason is that at the step of forming the outer circumferential frustoconical portion, further formation of wrinkles is induced by these wrinkles. For example, in the case where a flat-bottom cup is prepared by the draw forming using a drawing punch having a shape corresponding to the shape of the intended flat-bottom cup, it is preferred that the punch radius $R_p$ be large, as pointed out hereinbefore, but if the punch radius is too large, wrinkles are formed in this portion. This tendency is conspicuous as the strength of the material is higher or the thickness is smaller.

Referring to FIG. 1 illustrating respective members used for the draw forming of the bottom, a cylindrical punch represented as a whole by referential numeral 1, an annular die represented by reference numeral 2 and a doming die represented by referential numeral 3 are arranged coaxially with one another. The cylindrical punch 1 has an outer circumferential plane 4 having a diameter $D_1$ and an inner circumferential plane 5 having a diameter $D_3$, and the cylindrical punch 1 has a substantially tapered acting plane 6 corresponding to the outer circumferential frustoconical portion of the bottom of the final barrel and a projecting portion 7 in the lower part in the drawings. The projecting portion 7 has a small radius $r_1$ of curvature, and a connecting portion 8 between the acting plane 6 and the outer circumferential plane 4 has a relatively large radius $r_3$, while the acting plane 6 is an upwardly convex curvature plane (curvature radius$=r_2$).

The annular die 2 has an introducing portion 9 having a large diameter and an acting plane 10 which is an upwardly convex curved plane having a radius $r_5$ of curvature substantially equal to or slightly smaller than the curvature radius $r_2$ of the punch. The outer circumferential frustoconical portion is formed by the joint action of the punch 1 and die 2.

The doming die 3 has an acting plane 11 comprising an upwardly convex domed curved plane (curvature radius $=r_4$), and the diameter $D_4$ of the doming die is slightly smaller than the inner diameter $D_3$ of the punch and the doming die 3 can be telescopically inserted into the cylindrical punch 1 and drawn out therefrom.

A can barrel 12 having a bottom to be draw-formed comprises a circumferential side wall 13 and a flat bottom 14, and the cylindrical punch 1 is inserted into the interior of the barrel 12 to effect the draw forming of the bottom.

Figure 2:
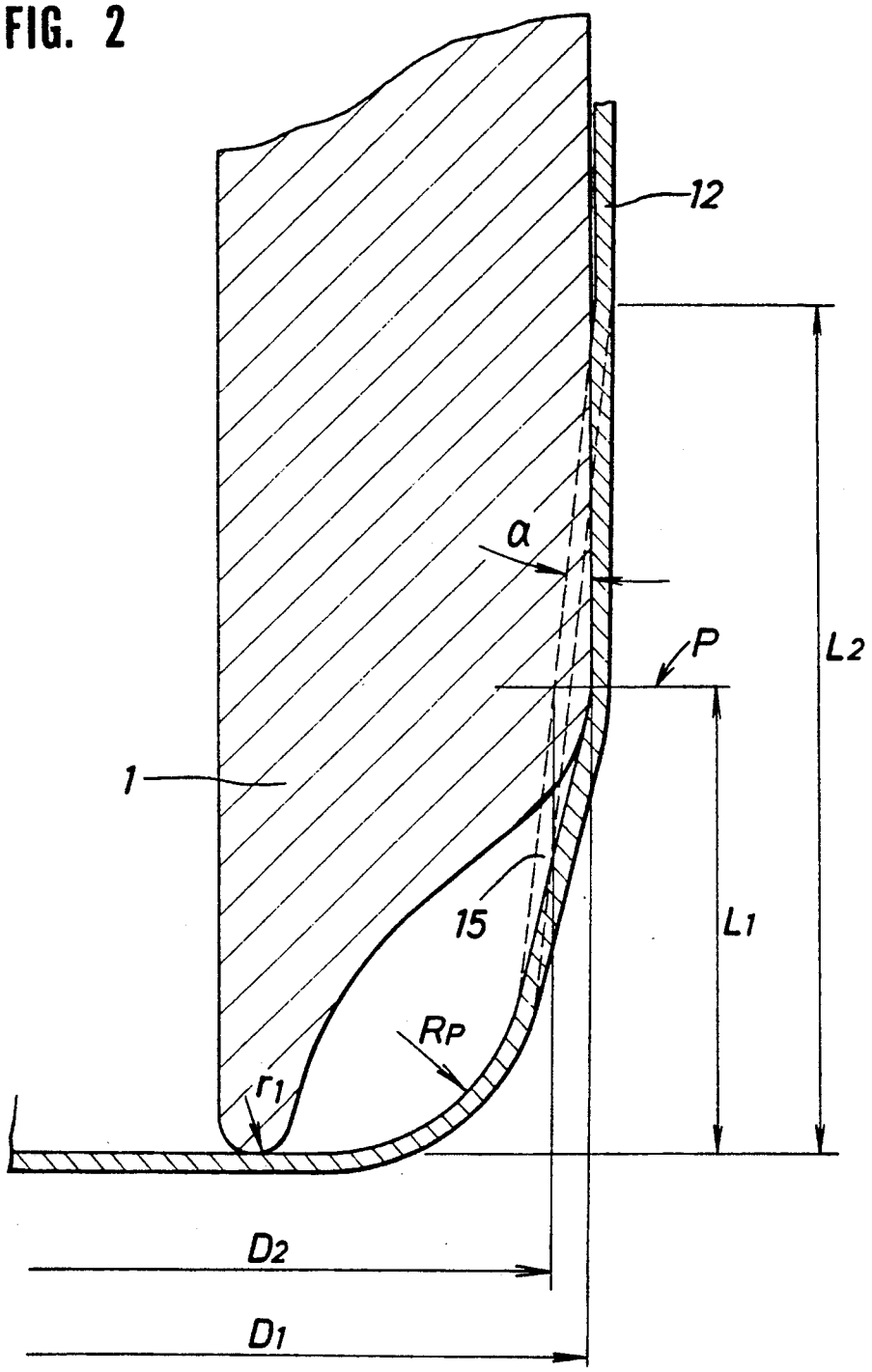
FIG. 2 is a diagram illustrating, partially in section, the dimensional relation between a cylindrical punch 1 and a flat-bottom cup 12 as a workpiece.

Referring to FIG. 2 illustrating the principle of the present invention, the flat-bottom barrel to be draw-formed is indicated by a dotted line, and the state where the cylindrical punch is inserted into this flat-bottom barrel is indicated by a solid line.

According to the present invention, prior to the draw forming of the bottom (the dome-forming step), a taper portion 15 is formed on a lower part of the side wall of the flat-bottom barrel 12, corresponding to the outer circumferential frustoconical portion of the final can barrel and an upper portion contiguous to the outer circumferential frustoconical portion.

This taper portion 15 has an angle $\alpha$ such that the inner diameter gradually decreases toward the bottom surface. At least an upper part of the taper portion 15 is expanded outwardly of the diameter by insertion of the cylindrical punch 1 into the taper portion 15.

It is obvious that supposing that the lowermost position P of a maximum-diameter portion of the cylindrical punch 1 is a reference position, the height from the bottom surface to this reference position P is $L_1$, the height of the point of initiation of the inclination of the taper portion 15 of the barrel from the bottom surface is $L_2$, the outer diameter of the punch at the reference position P is $D_1$ and the inner diameter of the barrel at the same height as the reference position P is $D_2$, if the following requirements are satisfied:

$$L_2/L_1 \geqq 1.0, \quad (1-a)$$

especially, $$L_2/L_1 > 1.0, \quad (1)$$

and $$\frac{D_1 - D_2}{D_2} \times 100 > 0\%, \quad (1-b)$$

especially, $$\frac{D_1 - D_2}{D_2} \times 100 = 0.1 \text{ to } 5\%, \quad (2)$$

an expansion outward of the diameter is caused by the insertion of the cylindrical punch 1. By this outward expansion, as pointed out hereinbefore, the tensile stress in the circumferential direction is generated and the compressive stress in the circumferential direction, which causes formation of wrinkles, can be reduced by this tensile stress.

Referring to FIGS. 3-A, 3-B, 3-C and 3-D illustrating the operation sequence (steps) of the method for draw-forming the bottom according to the present invention, a flat-bottom can barrel having a taper portion formed in advance at a lower part of the side wall is supported by the acting plane 10 of the annular die 2, and the cylindrical punch 1 is inserted into the barrel 12 (FIG. 3-A). As shown in FIG. 3-B, the cylindrical punch 1 is inserted until the projecting portion 7 of the punch 1 reaches the bottom 14 of the can barrel. At this point, as shown in FIG. 2, the upper part of the taper portion is expanded outwardly of the diameter, and therefore, a tensile stress is left in the remaining part 15*a* of the taper portion. Then, the cylindrical punch 1 is further moved downward, and the draw forming to an outer circumferential frustoconical portion 16 is carried out by the acting plane 10 of the annular die and the acting plane 6 of the cylindrical punch (FIG. 3-C). In this case, since the draw forming is carried out under such conditions that the tensile stress is left in the taper portion 15, the compressive stress causing formation of wrinkles is moderated or cancelled.

Finally, the combination of the cylindrical punch 1 and annular die 2 is moved downward, and is engaged with the flat bottom 14 so that the doming die 3 is relatively intruded in the cylindrical punch, whereby a projecting portion 17 and a domed portion 18 are formed.

As is apparent from the foregoing illustration, according to the present invention, formation of wrinkles at the draw forming of the bottom is effectively prevented and the forming workability is improved, and a bottom having a good appearance, a high strength and an excellent corrosion resistance is obtained.

Various surface-treated steel sheets and aluminum sheets can be used as the metal sheet in the present invention.

As the surface-treated steel sheet, there can be used products obtained by annealing a cold-rolled steel sheet, subjecting the steel sheet to secondary cold rolling and subjecting the steel sheet to at least one of surface treatments such as zinc plating, tin plating, nickel plating, electrolytic chromate treatment, aluminum plating and chromate treatment. A preferred example of the surface-treated steel sheet is an electrolytically chromate-treated steel sheet having 10 to 200 mg/m$^2$ of a metallic chromium layer and 1 to 50 mg/m$^2$ (as metallic chromium) of a chromium oxide layer, and this surface-treated steel sheet is excellent in the coating adhesion and the corrosion resistance. Another example of the surface-treated steel sheet is a tinplate sheet having a tin deposition quantity of 0.5 to 11.2 g/m$^2$. Any of a reflow sheet (bright sheet) and a noreflow sheet (mat sheet) can be used. A pure aluminum sheet and known aluminum alloy sheets for cans, such as Al-Mn and Al-Mg alloy sheets can be used as the aluminum sheet.

A surface-treated steel sheet having a thickness of 0.05 to 0.5 mm, especially 0.10 to 0.30 mm, is used, and an aluminum sheet having a thickness of 0.1 to 0.5 mm, especially 0.20 to 0.4 mm, is used.

In the present invention, prominent advantages can be attained when a high-strength thin steel sheet having a thickness of 0.05 to 0.5 mm, especially 0.10 to 0.20 mm, and a tensile strength of at least 30 kg/mm$^2$, especially 50 to 90 kg/mm$^2$, is used.

A protecting covering can be formed on the metal sheet used in the present invention prior to the forming, or a protecting covering can be formed after the forming.

As the protecting paint for forming this protecting covering, there can be used optional protecting paints comprising thermosetting and thermoplastic resins. For example, there can be used at least one member selected from modified epoxy paints such as a phenol-epoxy resin and an amino-epoxy paint, vinyl and modified vinyl paints such as a vinyl chloride/vinyl acetate copolymer, a partially saponified vinyl chloride/vinyl acetate copolymer, a vinyl chloride/vinyl acetate/-maleic anhydride copolymer, an epoxy-modified vinyl resin, an epoxyamino-modified vinyl resin and an epoxyphenol-modified vinyl resin, acrylic resin paints, and synthetic rubber paints such as a styrene/butadiene copolymer.

The paint can be applied in the form of an organic solvent solution such as an enamel or a lacquer, or an aqueous dispersion or solution, to the metal blank by roller coating, spray coating, dip coating, electrolytic coating or electrophoretic coating. Of course, in the case where the resin paint is thermosetting, the paint is based according to need. Furthermore, if draw-ironing is carried out, the paint is applied to the barrel of the formed cup by spray coating. Of course, the paint can be applied two times, that is, before and after the cup forming.

In order to improve the anti-corrosive effect and the workability, it is preferred that the organic covering should have a thickness (in the dry state) of 2 to 30 μm, especially 3 to 20 μm.

The metal sheet used in the present invention can be a laminate of a metal sheet and a resin film. This laminate can be prepared by heat-bonding a resin film to both the surfaces of the metal sheet or by bonding a resin film to the metal sheet through an adhesive or an adhesive primer.

A single-layer or multi-layer thermoplastic resin film can be used as the resin film. For example, there can be used at least one member selected from polyolefins such as polyethylene, polypropylene, an ethylene/propylene copolymer, an ionomer, an ethylene/acrylic acid ester copolymer and an ethylene/vinyl acetate copolymer, polyesters such as polyethylene terephthalate and polyethylene terephthalate/isophthalate, polyamides such as nylon 6, nylon 66 and a nylon 6/nylon 66 copolymer, polycarbonates, and polysulfones. The film can be an undrawn film or a biaxially drawn film. It is preferred that the thickness of the film be 5 to 100 μm, especially 10 to 30 μm. A thermoplastic adhesive such as acid-modified olefin resin, copolyester or copolyamide adhesive, or a thermosetting adhesive such as an epoxy or urethane adhesive can be used for bonding the resin film to the metal sheet, though the adhesive need not be used if the film has a heat bondability to the metal sheet. Alternatively, an adhesive primer of the epoxy-phenol type can be used also for attaining an anti-corrosive effect in the metal sheet.

In the present invention, the drawing is carried out in a plurality of stages while gradually decreasing the diameters of the punch and die until a desired shape and a desired height/diameter ratio are attained.

At this drawing, it is preferred that the draw ratio defined by the following formula:

$$\text{Draw ratio} = \frac{\text{diameter before drawing}}{\text{diameter after drawing}}$$

be 1.20 to 2.10, especially 1.30 to 1.90, in one stage, and the total draw ratio be 1.50 to 3.00, especially 1.80 to 2.70.

In the case where the side wall is subjected to ironing, it is preferred that the ironing ratio defined by the following formula:

$$\text{Ironing ratio} = \frac{\text{blank thickness} - \text{thickness after ironing}}{\text{blank thickness}} \times 100$$

be 10 to 50%, especially 15 to 45%, in one stage, and the total ironing ratio be 40 to 80%, especially 45 to 75%.

At the redrawing step, the thickness of the side wall can be reduced by bending elongation using a redrawing die, in which the radius of curvature of the acting portion of the die is very small and 1.0 to 2.9 times the thickness of the blank, so that the thickness of the side wall is reduced to a value smaller by 0 to 40%, especially 5 to 40%, than the thickness of the bottom.

In the present invention, formation of the taper portion at the lower part of the side wall is most simply accomplished by using a punch having a corresponding taper plane when the drawing of the final stage or the ironing is carried out. Of course, if desired, a deforming operation for forming a taper portion can be carried out independently from the drawing or draw-ironing.

The formed cup body is subjected to trimming, and if necessary, the cup is then subjected to a known degreasing operation such as warm water washing or solvent washing. Then, the cup is subjected to ordinary can-forming operations.

The present invention will now be described in detail with reference to the following examples that by no means limit the scope of the invention.

EXAMPLE 1

Figure 4:
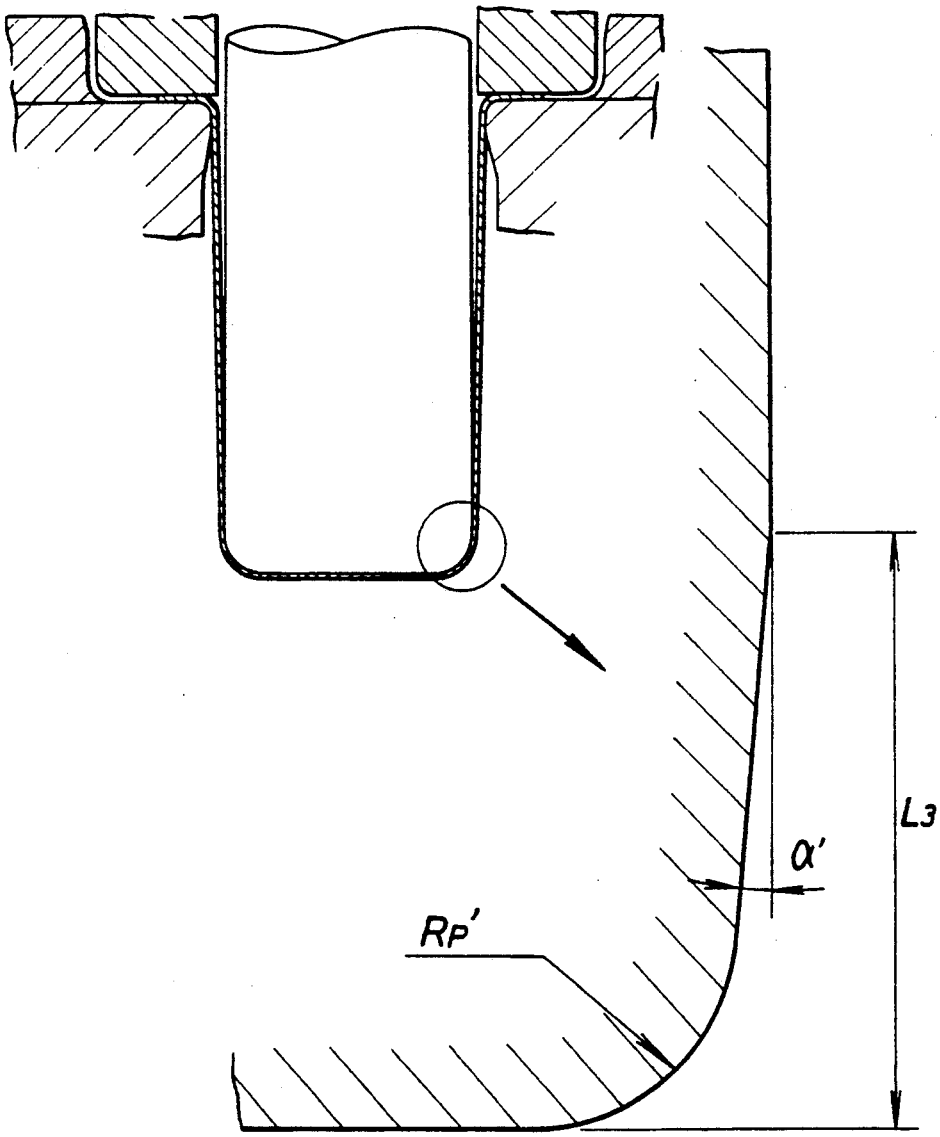
FIG. 4 is an enlarged sectional view illustrating the tool used in Example 1.

A thermosetting resin paint was coated and baked on both the surfaces of a tin-free steel (tensile strength =about 63 Kgf/mm$^2$: DR-9) having a blank thickness of 0.15 mm and the coated steel sheet punched into a disk having as diameter of 179 mm. The disk was drawn and redrawn between a drawing punch and a drawing die according to customary procedures to obtain a flat-bottom cup having an inner diameter of 65.9 mm. The shape of the top end portion of the punch used at the final drawing step was such that in FIG. 4, L3 was 15 mm, $\alpha'$ was 2° and Rp' was 5 mm. A taper having the inner diameter gradually decreasing toward the bottom surface was formed at a lower part of the side wall of the flat-forming cup prepared by using this punch. The distance L2 between the bottom surface and the point of initiation of the inclination of the taper portion was substantially equal to L3 and was about 15 mm, and the value of L2/L1 was 1.5. Moreover, the value of $(D1-D2)/D2\times 100$ was about 0.3%.

The obtained cup-shaped body was subjected to the bottom-forming operation using bottom-forming tools, that is, a cylindrical punch 1, an annular die 2 and a doming die 3 (see FIGS. 3-A, 3-B, 3-C and 3-D). The main dimensions of the cylindrical punch 1 were such that D1 was 65.8 mm, D3 was 49.3 mm, r1 was 0.7 mm, r2 was 10.5 mm, r3 was 3.0 mm and L1 was 10 mm. The main dimensions of the doming die 3 were such that D4 was 48.7 mm and r4 was 40 mm.

The annular die 2 was supported from below by an air cushion, and the supporting force was about 3 tons.

Formation of wrinkles was not observed in the inner circumferential frustoconical portion of the formed can bottom and a can body having an intended beautiful appearance was obtained. The pressure resistance test of the obtained can body was carried out in the state where the distance between the ground surface and the apex of the dome portion was 11.0 mm, and it was found that the inner pressure-resistant strength (buckling pressure) of the bottom was at least 6.3 kg/cm$^2$ and the strength was practically satisfactory.

In order to example the exposure of the metal to the inner surface of the bottom, the enamel rater value (ERV) was measured and the immersion test in an aqueous solution of copper sulfate was carried out. It was found that the enamel rater value was 0 mA. At the copper sulfate test, the exposure of the metal was not observed.

The enamel rater value measurement was carried out in a 1% aqueous solution of NaCl as the test solution by applying a voltage of 6.3 V.

The evaluation of the metal exposure is made on the current value. It is said that as the current value is large, the metal exposure is large, and as the current value is zero or close thereto, the metal exposure is small.

COMPARATIVE EXAMPLE 1

Figure 5:
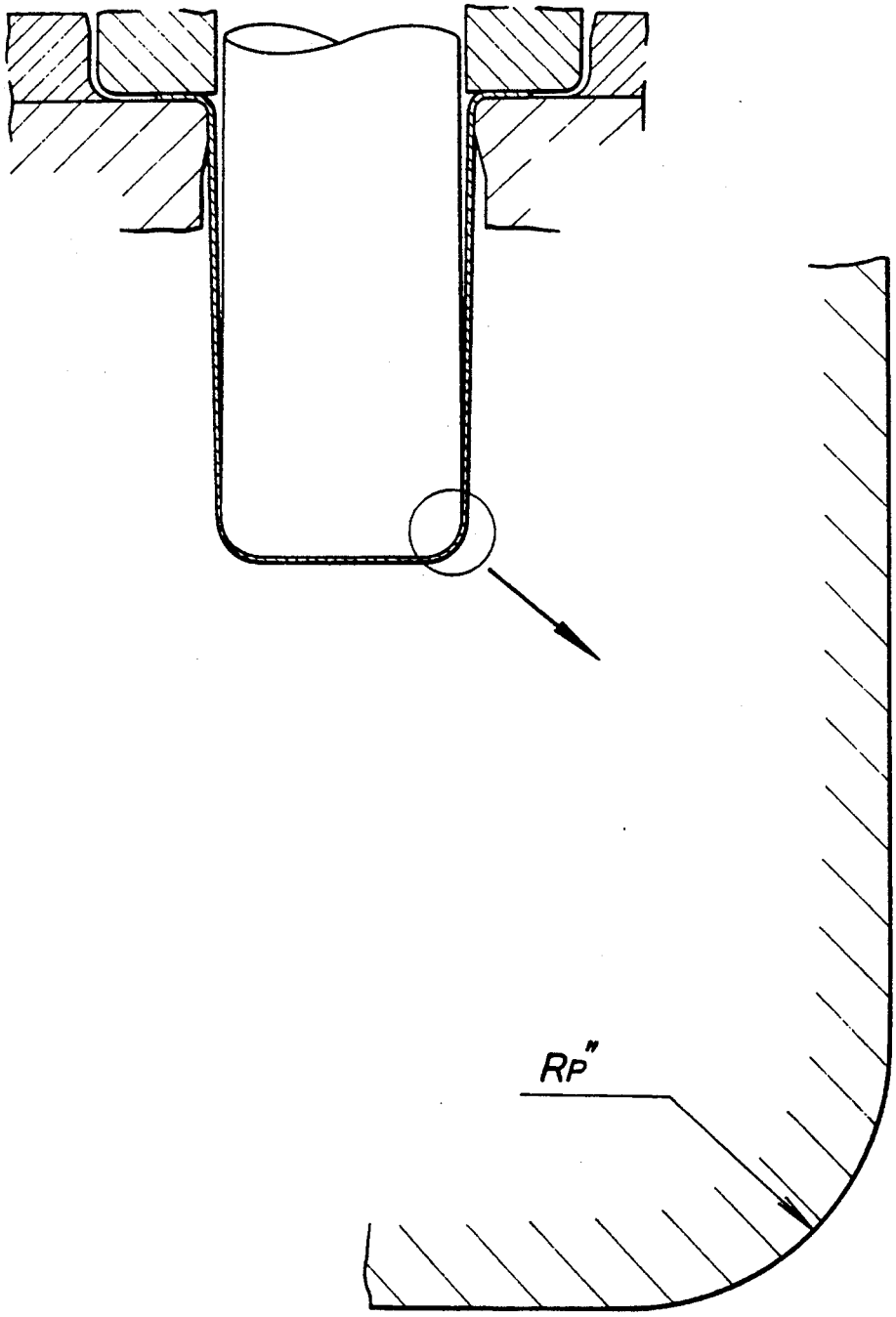
FIG. 5 is an enlarged sectional view illustrating the tool used in Comparative Example 1.

A thermosetting resin paint was coated and baked on both the surfaces of a tin-free steel (tensile strength =about 63 Kgf/mm$^2$: DR-9) having a blank thickness of 0.15 mm and the coated steel sheet punched into a disk having a diameter of 179 mm. The disk was drawn and redrawn between a drawing punch and a drawing die according to customary procedures to obtain a flat-bottom cup having an inner diameter of 65.9 mm. The shape of the punch used at the final drawing step was as shown in FIG. 5. The radius Rp" was 5 mm. In the side wall of the flat-bottom cup formed by using the punch, the inner diameter was about 65.9 mm and substantially constant from the open end to the point just before the portion corresponding to the radius Rp" of the outer circumference of the can bottom.

This cup-shaped body was subjected to the forming operation by using the same bottom-forming tools as used in Example 1.

Many wrinkles were formed in the outer circumferential frustoconical portion of the can bottom, and the appearance of the bottom was degraded by these wrinkles.

In order to examine the metal exposure on the inner surface of the bottom, the enamel rater value (ERV) was measured and the immersing test was carried out in an aqueous solution of copper sulfate. Conspicuous metal exposure was observed in the winkle-formed portion, and the enamel rater value was larger than about 3 mA, and the formed body could not be used as a canning vessel.

As is apparent from the results of the foregoing examples, according to the present invention, in carrying out the forming method, which comprises the step of forming a barrel having a flat bottom by subjecting a metal sheet to drawing or draw-ironing, and the step of supporting the bottom of the barrel by a cylindrical punch and an annular die, having shapes corresponding to an outer circumferential frustoconical portion and a projecting portion of the bottom of the final barrel and draw-forming the bottom while engaging the bottom with a doming die having an outer diameter slightly smaller than the inner diameter of the cylindrical punch, if before the step of draw-forming the bottom, a taper portion having an inner diameter gradually decreasing toward the bottom surface is formed on a lower part of the side wall of the flat-bottom barrel, corresponding to the outer circumferential frustoconical portion of the bottom of the final barrel or an upper portion contiguous to the outer circumferential frustoconical portion, and at the step of draw-forming the bottom, at least an upper part of the taper portion is outwardly expanded by insertion of the cylindrical punch, the tensile stress is left in the portion to be draw-formed and the compressive stress causing formation of wrinkles is moderated and cancelled by this tensile stress, and a two-piece can having a bottom having a good appearance, a high pressure-resistance strength and an excellent corrosion resistance can be prepared at a high productivity and with an excellent operation adaptability.

We claim:

1. A method for forming a barrel for a two-piece can, comprising the following steps:

forming a barrel having a flat bottom by subjecting a metal sheet to drawing or draw-ironing;

forming a taper portion in the side wall of the barrel adjacent said bottom wall having an inner diameter gradually decreasing toward the bottom wall of the barrel;

supporting the bottom of said barrel using an annular die having a circumferential frustoconical portion having a shape corresponding to the shape of a portion of the bottom of the final barrel;

inserting a cylindrical punch in said barrel, said punch having an outer circumferential frustoconical portion complimentary to the shape of said frustoconical portion of said annular die so as to mate therewith and having an outer diameter greater than the inner diameter of the barrel taper portion, insertion of said punch causing at least a portion of said taper portion of said barrel to expand radially outwardly, said punch having an annular projecting portion extending downwardly therefrom defining a recess therein; and draw-forming the bottom while engaging the bottom with a doming die having an outer diameter slightly smaller than a diameter of said recess, said doming die being disposed at least partially in said recess so as to form a dome portion of the bottom of said barrel.

2. The method of claim 1, wherein in the step of forming a taper, the following is satisfied:

$$L_2L_1 > 1.0$$

wherein $L_2$ represents the height of the taper portion for the top of the projection portion, $L_1$, represents the height of the cylindrical punch corresponding to the outer circumferential frustoconical portion from the top of the project portion, and at the step of draw-forming the bottom, at least an upper part of the taper portion is outwardly expanded by insertion of the cylindrical punch so that the following requirement is satisfied:

$$\frac{D_1 - D_2}{D_2} \times 100 = 0.1 \text{ to } 5\%$$

wherein $D_1$ represents the diameter of the punch at the height $L_1$, and $D_2$ represents the inner diameter the barrel at the height $L_1$.

* * * * *